US005644187A

United States Patent [19]

Jaskie et al.

[11] Patent Number: 5,644,187

[45] Date of Patent: Jul. 1, 1997

[54] COLLIMATING EXTRACTION GRID CONDUCTOR AND METHOD

[75] Inventors: James E. Jaskie; Lawrence N. Dworsky, both of Scottsdale, Ariz.

[73] Assignee: Motorola, Schaumburg, Ill.

[21] Appl. No.: 345,040

[22] Filed: Nov. 25, 1994

[51] Int. Cl.[6] ..... H01J 1/46

[52] U.S. Cl. ..... 313/293; 313/309; 313/310; 313/336; 313/495; 313/422

[58] Field of Search ..... 313/309, 336, 313/351, 310, 495, 496, 493, 497, 422, 293

[56] References Cited

U.S. PATENT DOCUMENTS 5,142,184 8/1992 Kane ..... 315/336
5,235,244 8/1993 Spindt ..... 313/336
5,281,891 1/1994 Kaneko et al. ..... 313/336
5,446,337 8/1995 Yokomakura et al. ..... 313/422

*Primary Examiner*—Nimeshkumar Patel
*Attorney, Agent, or Firm*—Eugene A. Parsons

[57] ABSTRACT

A an electron source utilizes a novel extraction grid conductor (20,40,41) to assist in focusing an electron beam emitted by the electron source. The extraction grid conductor (20,40,41) has a collimating conductor (29,31) that separate an extraction grid section (17,21,22) of the extraction grid conductor from conducting strips (26,24,32,33) that electrically connect the extraction grid section (17,21,22) to an external voltage source. The collimating conductor (29,31) creates an electric field that prevents emitted electrons from being attracted to the conducting strips (26,24,32,33) thereby maintaining the emitted electron beam in a substantially column-like configuration.

12 Claims, 1 Drawing Sheet

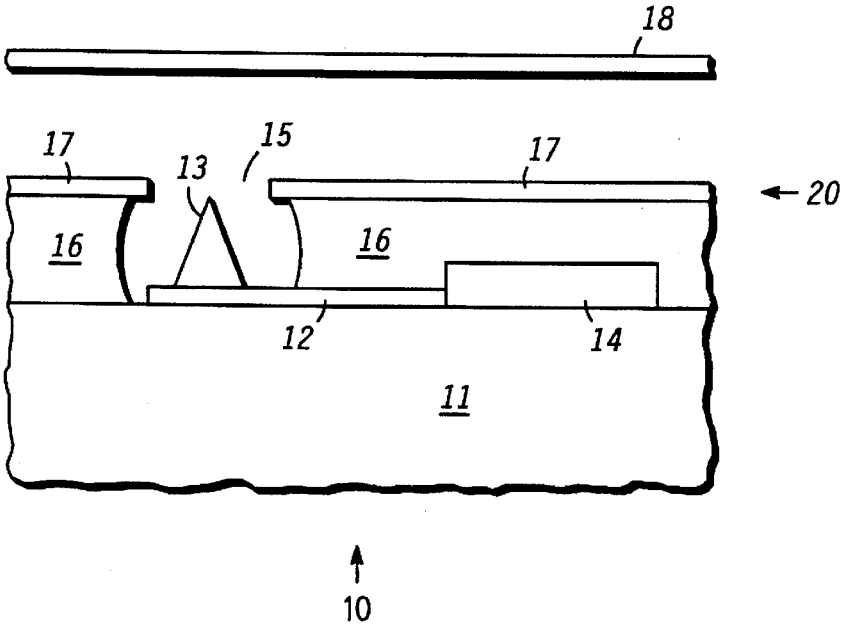
FIG. 1
FIG. 2
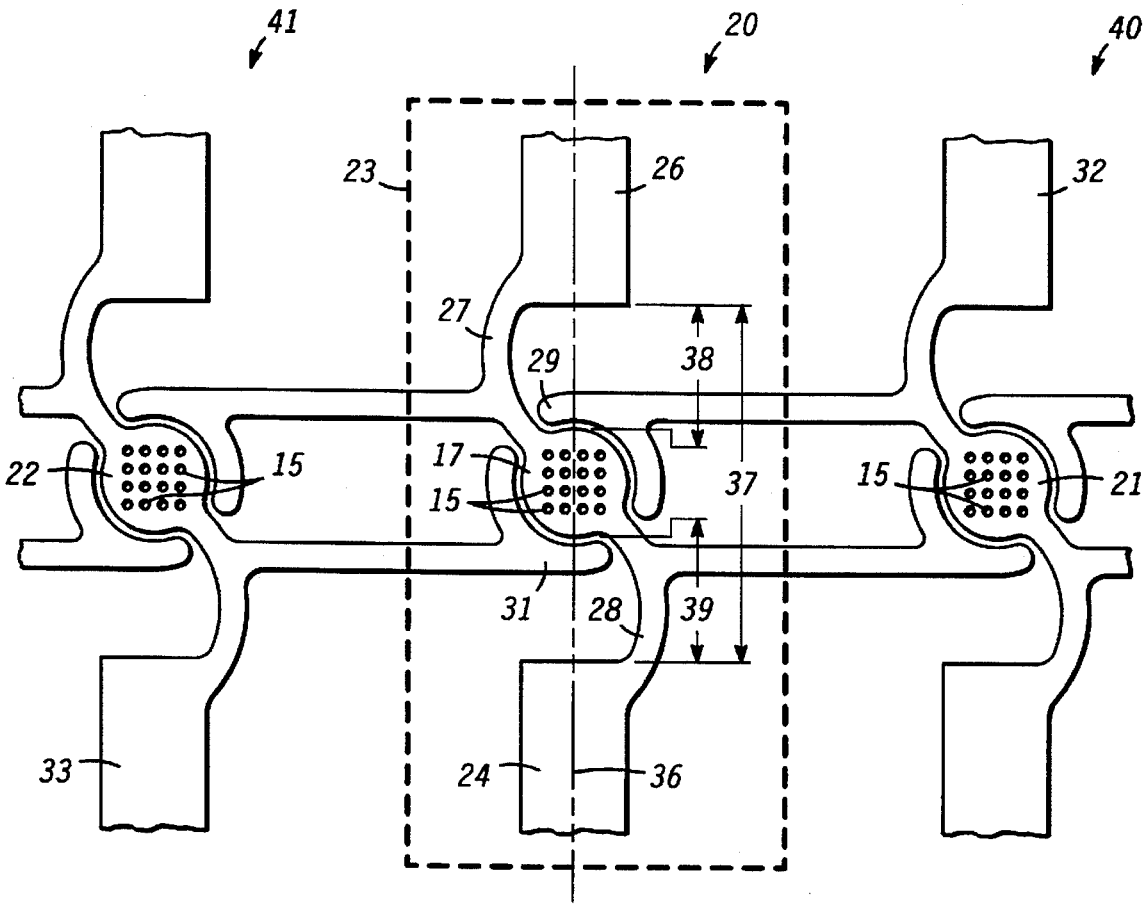

COLLIMATING EXTRACTION GRID CONDUCTOR AND METHOD

BACKGROUND OF THE INVENTION

The present invention relates, in general, to electron emission devices, and more particularly, to a novel extraction grid for an electron source.

Field Emission Devices (FEDs) are well known in the art and are commonly employed for a broad range of applications including image display devices. An example of a FED is described in U.S. Pat. No. 5,142,184 issued to Robert C. Kane on Aug. 25, 1992. FEDs typically have a plurality of closely spaced electron emission tips or emitters that are utilized to illuminate a pixel on a phosphor screen. An emission gate or extraction grid typically is positioned between the emitters and the screen, and is utilized to stimulate electron emission from the emitters. The extraction grid has a hole over each emitter in order to allow electrons to travel from the emitter to the screen. As the electrons travel the distance from the extraction grid to the screen, the electrons diverge thereby resulting in an image having an area that is larger than the area of the extraction grid. This divergence makes it difficult to focus a pixel into a sharp image.

Accordingly, it is desirable to have an electron source extraction grid that reduces divergence of the electron beam that passes through the extraction grid of the electron source.

BRIEF DESCRIPTION OF THE DRAWINGS

FIG. 1 illustrates an enlarged cross-sectional portion of a field emission display device in accordance with the present invention; and FIG. 2 schematically illustrates a plan view of a plurality of extraction grids in accordance with the present invention.

DETAILED DESCRIPTION OF THE DRAWINGS

FIG. 1 illustrates an enlarged cross-sectional portion of a field emission display device 10 that has an electron source with a novel collimating extraction grid conductor that minimizes electron beam divergence. Device 10 includes a substrate 11 on which other portions of device 10 are formed. Substrate 11 typically is an insulating or semi-insulating material, for example, silicon having a dielectric layer or glass. In the preferred embodiment, substrate 11 is glass. The electron source of device 10 includes a resistive layer 12 that generally is formed on substrate 11. An electron emission tip or emitter 13 of the electron source is formed on layer 12, and a column conductor 14 is utilized to provide electrical contact between emitter 13 and an external voltage source (not shown). The electron source also includes an extraction grid section 17 that is disposed on a dielectric layer 16. Layer 16 is on substrate 11, conductor 14, and layer 12 in order to electrically isolate extraction grid section 17 from substrate 11, layer 12, and conductor 14. As will be seen hereinafter, extraction grid section 17 is a portion of a novel collimating extraction grid conductor or first extraction grid conductor 20. Extraction grid section 17 has an emission opening 15 that is substantially centered to emitter 13. The area where conductor 20 overlays conductor 14, and emitter 13 generally is referred to as a pixel area of device 10. Device 10 also includes an anode 18 that has a phosphor coating on the surface facing emitter 13 in order to provide a display as electrons strike anode 18.

FIG. 2 illustrates an enlarged plan view of a portion of a plurality of collimating extraction grid conductors including a portion of first extraction grid conductor 20. Elements of FIG. 2 that are the same as FIG. 1 have the same reference numbers. Conductor 20 includes a first extraction grid conductor strip 26 and a second extraction grid conductor strip 24 that is co-extensive to strip 26. Strips 24 and 26 are in the same plane as section 17, and are separated by a first space 37, illustrated by an arrow. Section 17 is within space 37 between strips 24 and 26. As indicated in the description of FIG. 1, section 17 has a plurality of emission openings 15 overlying a plurality of emitters (not shown). Section 17 is separated from strip 24 by a second space 39 and from strip 26 by a third space 38. Spaces 38 and 39 are illustrated by arrows. Strips 24 and 26 have a major axis 36 running along a length of strips 24 and 26.

Conductor 20 also includes a first collimating conductor or first collimator 29 and a second collimating conductor or second collimator 31 that assist in containing electrons passing through openings 15 in a column-like configuration. First collimator 29 is a conductor that is co-planar with section 17 and strips 26 and 28, and is positioned so that at least a portion of collimator 29 is in space 38. Similarly, collimator 31 is a conductor that is co-planar with strips 24 and 26, and is positioned so that at least a portion of collimator 31 is within space 39 between section 17 and strip 24. Collimators 29 and 31 are formed near the periphery of section 17 in order to create an electric field as close to section 17 as possible, as will be seen hereinafter. Collimator 29 bisects axis 36 and has a length on each side of axis 36 that is at least equal to one-half the width of strip 26 in order to minimize the effect of any electric fields created by potentials applied to strip 26, as will be seen hereinafter. Similarly, collimator 31 bisects the major axis of strip 24 and has a length on each side of axis 36 that is at least one-half the width of strip 24. In the preferred embodiment, section 17 and collimators 29 and 31 are devoid of any sharp corners in order to minimize the effects of dense electric fields created by such angles. Also in this preferred embodiment, section 17 has a substantially circular shape, and each collimator 29 and 31 is substantially arc-shaped and extends at least approximately sixty degrees around section 17 in order to minimize the effects of any electric fields created by strips 24 and 26. Collimator 29 is electrically connected to a conductor strip 32 that is part of a second extraction grid conductor 40 that is similar to conductor 20 and juxtaposed to conductor 20. Similarly, collimator 31 is electrically connected to a conductor strip 33 that is part of a third extraction grid conductor 41 that is also similar to conductor 20 and juxtaposed to conductor 20. As will be seen hereinafter, the electrical connection of collimators 29 and 31 to conductors 40 and 41, respectively, facilitates maintaining the emitted electron beam in a substantially column-like configuration and minimizes divergence. Conductors 40 and 41 also include extraction grid sections 21 and 22, respectively, that are similar to section 17. An interconnect strip 27 extends from strip 26 around and past collimator 29 and electrically connects to section 17. Similarly, an interconnect strip 28 extends from strip 24 around and past collimator 31 in order to electrically connect section 17 to strip 24.

In operation, a voltage is applied to conductor 20 in order to extract electrons from emitters 13 (FIG. 1) and accelerate them toward anode 18 (FIG. 1). Conductors 40 and 41 are maintained at a lower potential in order to prevent extracting electrons from emitters underlying extraction grid sections 21 and 22. Because collimator 29 is electrically connected to conductor 40 and collimator 31 is electrically connected to conductor 41, collimators 29 and 31 are at a much lower potential than strips 24 and 26. Consequently, this lower voltage creates an electric field near the periphery of section 17 that repels electrons thereby preventing the electrons from being attracted towards the large positive potential applied to strips 24 and 26. In the preferred embodiment, a potential of at least 10 volts is applied to strips 24 and 26 and a potential no greater than ground is applied to collimators 29 and 31. In prior art extraction grids that do not have collimators, electrons passing through emission openings near the conductor portion of the extraction grid tend to be attracted toward the conductor portion and result in an electron beamed that diverges as it transits to the anode. However, separating conductor strips 24 and 26 from section 17 and creating an electric field near the periphery of section 17 wherein the electric field has a lower intensity than the electric field created by the conductors strips, results in maintaining electrons that pass through section 17 in a column-like configuration. It should be noted that collimator 29 and collimator 31 could be connected to other conductors that have a lower potential than that of conductor 20. For example, a separate focusing conductor could be positioned between conductor 20 and conductor 40 and electrically connected to collimator 29 wherein a potential that is lower than the potential applied to conductor 40 is applied to the separate focusing conductor.

By now it should appreciated that there has been provided a novel extraction grid conductor for an electron source. By forming an electric field near the periphery of the extraction grid section of the extraction grid conductor, electrons are repelled from the conducting sections of the extraction grid conductor so that the electrons maintain a column-like configuration and divergence is minimized. Positioning a collimator conductor between a conducting strip and an extraction grid section of the extraction grid conductor facilitates creating the electric field around the extraction grid section.

We claim:

1. An electron source extraction grid conductor comprising:

a first conductor strip;

a second conductor strip;

an extraction grid section that is spaced apart from the first and second conductor strips and electrically connected to the first and second conductor strips; and a collimating conductor for creating an electric field between the extraction grid section and the first and second conductor strips, the electric field repels electrons that pass through the extraction grid section from the first and second conductor strips.

2. The extraction grid conductor of claim 1 wherein the electric field includes a first electric field between the extraction grid section and the first conductor strip and a second electric field between the extraction grid section and the second conductor strip.

3. The extraction grid conductor of claim 1, wherein the collimating conductor further includes a first collimating conductor between the extraction grid section and the first conductor strip and a second collimating conductor between the extraction grid section and the second conductor strip.

4. The extraction grid conductor of claim 3 wherein the first collimating conductor and the second collimating conductor are at a first potential that is less than a second potential applied to the first conductor strip and to the second conductor strip.

5. A method of focusing an electron source comprising:

creating an electric field adjacent to a periphery of an extraction grid section of an extraction grid conductor and between a first extraction grid conductor strip and the extraction grid section so that electrons passing through the extraction grid section are repelled from the extraction grid conductor.

6. The method of claim 5 further including creating the electric field between a second extraction grid conductor strip and the extraction grid section.

7. The method of claim 6 wherein creating the electric field adjacent the periphery of the extraction grid section includes creating a first electric field adjacent to a first portion of the periphery and a second electric field adjacent to a second portion of the periphery.

8. The method of claim 7 wherein creating the first electric field adjacent to the first portion of the periphery includes creating the first electric field adjacent to the first portion of the periphery that is opposite the second portion of the periphery.

9. The method of claim 5 wherein creating the electric field between the first extraction grid conductor strip and the extraction grid section includes the electric field bisecting a major axis of the extraction grid conductor wherein the major axis passes through the extraction grid section.

10. The method of claim 5 wherein creating the electric field adjacent the periphery of the extraction grid section includes positioning a first collimating conductor adjacent to the periphery.

11. The method of claim 10 wherein positioning the first collimating conductor adjacent to the periphery includes coupling the extraction grid section to a first potential and coupling the first collimating conductor to a second potential that is less than the first potential.

12. The method of claim 11 further including coupling the first potential to at least 10 volts and coupling the second potential to ground.

* * * * *